US005184596A

United States Patent [19]

Green et al.

[11] Patent Number: 5,184,596

[45] Date of Patent: Feb. 9, 1993

[54] BOWSTRING RELEASE SAFETY MECHANISM

[76] Inventors: James H. Green, Rte. 1, Box 315, North Wilkesboro, N.C. 28659; John F. Green, Jr., Rte. 2, Box 300, Boone, N.C. 28607

[21] Appl. No.: 831,156

[22] Filed: Feb. 5, 1992

[51] Int. Cl.[5] ..... F41B 5/00

[52] U.S. Cl. ..... 124/35.2; 124/40

[58] Field of Search ..... 124/35.1, 35.2, 40

[56] References Cited

U.S. PATENT DOCUMENTS

| | | | |
|---|---|---|---|
| 3,490,429 | 1/1970 | Benedict | 124/35 |
| 4,030,473 | 6/1977 | Puryear | 124/35 |
| 4,192,281 | 3/1980 | King | 124/25 |
| 4,206,740 | 6/1980 | Lydon | 124/25 |
| 4,294,222 | 10/1981 | Pelsue | 124/25 |
| 4,407,260 | 10/1983 | Lyons | 124/40 X |
| 4,466,418 | 8/1984 | Jones | 124/35 |
| 4,665,886 | 5/1987 | Barlow | 124/35.2 |
| 4,672,945 | 6/1987 | Carlton | 124/35 |
| 4,716,880 | 1/1988 | Adkins | 124/40 X |
| 4,721,092 | 1/1988 | Waiser | 124/40 |
| 4,791,908 | 12/1988 | Pellis | 124/35.2 |
| 5,020,508 | 6/1991 | Greene, Jr. | 124/35.2 |
| 5,025,771 | 6/1991 | Hanson | 124/25 |
| 5,031,600 | 7/1991 | Moore | 124/35.2 |
| 5,067,472 | 11/1991 | Vogel et al. | 124/40 X |

*Primary Examiner*—Peter M. Cuomo
*Assistant Examiner*—Jeffrey L. Thompson
*Attorney, Agent, or Firm*—Olive & Olive

[57] ABSTRACT

This invention provides a safety mechanism as an improvement to a bowstring release device and operative to prevent the accidental discharge of an arrow drawn in the bow. The safety mechanism disclosed comprises a slidable cam which is adapted to actuate a lock pin into a position to block the movement of a trigger member of the bowstring release device. When the safety mechanism is moved in the opposite direction, the lock pin is allowed to move away from the position blocking trigger movement under pressure of a biasing spring, thus freeing the trigger to operate.

6 Claims, 1 Drawing Sheet

BOWSTRING RELEASE SAFETY MECHANISM

FIELD OF THE INVENTION

The present invention relates to the field of archery apparatus, and more particularly to bowstring release devices.

BACKGROUND OF THE INVENTION

The use of a bow and arrow has had a long history of development from ancient times to the present. All the components, the bow, the string and the arrows, have undergone changes in materials and construction, but all have remained of a traditional and recognizable shape.

One particular development which has added to the technology of archery and does not fall within the scope of the traditional components is the bowstring release device. This is a device which aids the archer in the areas of both power and accuracy simultaneously. One such bowstring release device is described in U.S. Pat. No. 5,020,508 to John F. Greene, Jr., a co-inventor of the present invention. The teachings of the '508 patent are incorporated herein by reference. The device disclosed in the '508 patent has a pair of interlocked, cooperatively acting jaws to hold, and then to release the bowstring when the jaws are opened by moving a trigger. The '508 bowstring release device does its job well, except that it has been found through use of the '508 device that it is possible to accidently touch the trigger and discharge an arrow because of lack of a safety mechanism.

It is therefore an objective of the present invention to provide a safety mechanism to operate in conjunction with a bowstring release device so as to prevent accidental discharge of the arrow.

It is a further objective of the present invention to provide a safety mechanism which is useable with either the right or the left hand of the archer.

It is a further objective of the invention to provide a safety mechanism which will, once engaged, remain engaged until intentionally disengaged.

These and other objectives are incorporated in the present invention as will be apparent to those skilled in the art through the disclosure to follow.

SUMMARY OF THE INVENTION

The mechanism disclosed is an improvement to a bowstring release device and provides a safety mechanism to prevent the accidental discharge of an arrow. The safety mechanism comprises a slideable cam member which is mounted on the bowstring release device and is operable to press or release a pin into or out of position to interfere with the movement of the trigger of the bowstring release. The pin is retracted by means of a biasing spring when not engaged by the sliding cam member.

DESCRIPTION OF THE PREFERRED EMBODIMENT

Figure 1:
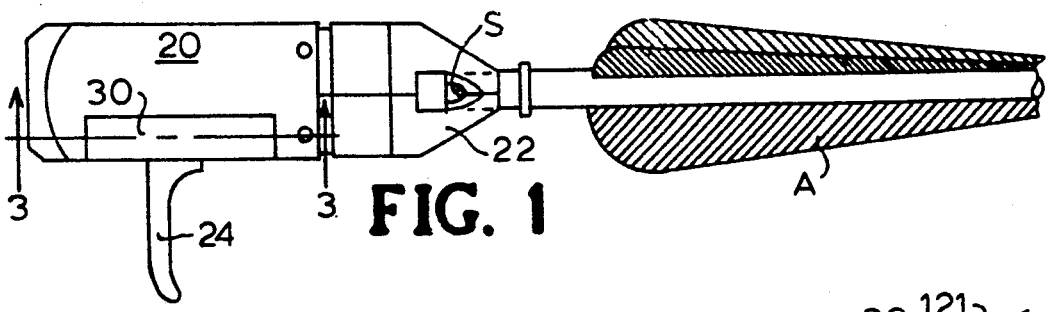
FIG. 1 is a top plan view of the safety mechanism of the present invention as mounted on a bowstring release device engaging an arrow ready for discharge, with the usual wrist attaching strap eliminated for purposes of illustration.

The invention disclosed provides a simple and effective safety mechanism which is used in conjunction with a bowstring release device to prevent the unintentional discharge of an arrow from a bow. FIG. 1 illustrates the bowstring release device with an arrow A mounted for discharge and with the safety device of the present invention assembled thereto. This drawing eliminates an arm attaching strap for simplicity of illustration. Arrow A is shown supported on string S which, being drawn back by the archer, is held securely between jaws 22 of the release device according to the teachings of U.S. Pat. No. 5,020,508. Jaws 22 are mounted in support means 20 such that when they are opened by pulling trigger 24, jaws 22 separate by simultaneous bilateral motion to release string S. Slide cam 30 of the invention is assembled to support means 20 and moves linearly in a direction parallel to the axis of arrow A.

Figure 2:
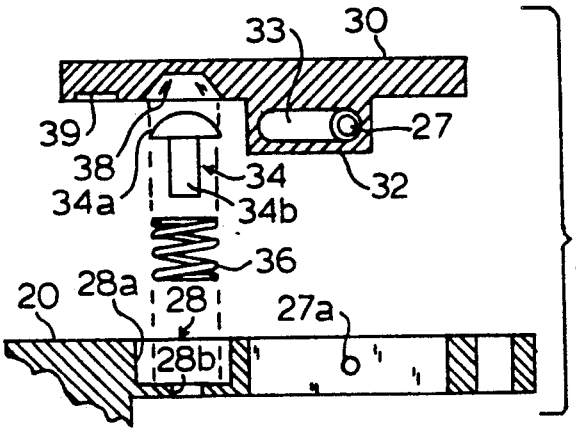
FIG. 2 is an exploded elevation sectional view of the components comprising the safety mechanism as ready for assembly to the previously known but modified support means.

Support means 20 requires minor modifications to be prepared for the addition of the safety mechanism of the invention as shown in FIG. 2. A hole 28 having an upper portion **28*a* and a lower portion 28*b* is formed with its upper and lower portions having a common axis perpendicular to the upper surface of support member 20. The upper portion 28*a* of hole 28 forms a well which is adapted to loosely accept spring 36 and head 34*a* of pin 34. The lower portion 28*b* of hole 28 is adapted to slidingly accept shank 34*b* and is open at its bottom end to recess 21 of support means 20. A second modification of support means 20 is to form guide track 26 as a substantially rectangular slot through and beneath the upper surface of support member 20. Guide track 26 is adapted to accept guide block 32 so that slide cam 30 slides linearly in contact with the upper surface of support means 20. Details of slide cam 30 will be disclosed below. Slide cam 30 moves from a first position in which concavity 38 allows spring 36 to raise pin 34 out of blocking engagement with trigger 24 to a second position in which recess 39 holds pin 34 down against the resistance of spring 36 to block the travel of trigger 24. A hole 27*a* is drilled and tapped into support means 20 at a position adjacent guide slot 33 and adapted to receive threaded fastener 27. The threaded hole 27*a* will be formed essentially in the middle of the stroke of guide slot 33 such that inserted retaining fastener 27 allows full travel of slide cam 30** from side to side as described above.

FIG. 2 further shows an exploded elevation sectional view of the actuating components of the safety mechanism of the invention. Sliding cam 30 is illustrated with concavity 38, recess 39 and guide block 32 on its lower face. Concavity 38 is preferably shaped as an internal truncated cone of appropriate depth, angle and diameter to accommodate head 34*a* of lock pin 34 (as shown assembled in FIG. 3). Recess 39 is formed as a depression in the underside of cam 30 that is linearly aligned with concavity 38 and adapted to accept a small portion of head 34*a* when slide cam 30 is in the engaged position (illustrated in FIG. 4). When slide cam 30 is in engaged position and a portion of the head 34*a* of pin 34 rests within recess 39, the upward pressure of spring 36 tends to prevent accidental movement of slide cam 30. When slide cam is in the non-engaged position (illustrated in FIG. 3) and head 34*a* is fully within concavity 38, trigger 24 may be freely moved. Shank 34*b* of lock pin 34 fits slidingly through the center of compression spring 36, which maintains upwardly biasing pressure against pin 34. Spring 36 is of a diameter and wire size to fit slidingly within well 28*a*. Guide block 32 has elongate slot 33 formed transversely therethrough, the long axis of slot 33 being parallel to the plane of movement of slide cam 30.

In assembly, lock pin 34 is passed through compression spring 36 and its shank 34*b* placed into hole lower portion 28*b* in support means 20. With slide cam 30 positioned so that concavity 38 encloses head 34*a*, head 34*a* protrudes above the top level of well 28*a* and the bottom end of shank 34*b* is approximately flush with the lower end of hole 28*b*. In the position described, illustrated in FIG. 3, pin 34 does not extend into recess 21 of support means 20 and therefore does not block the movement of trigger 24. Next, fastener 27 is inserted through guide slot 33 and threaded into preformed, mating hole 27*a* in support means 20 so as to secure sliding cam 30 in linearly moveable relation to support means 20.

Figure 3:
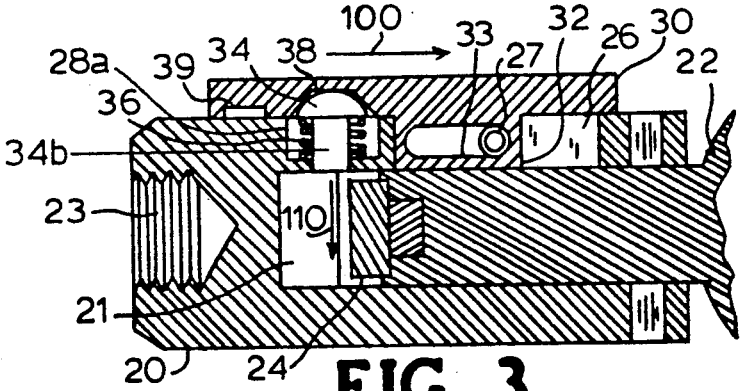
FIG. 3 is an elevation sectional view taken in the direction of line 3—3 of FIG. 1 and showing the safety mechanism in position to permit trigger movement of the bowstring release device.

FIG. 3 illustrates the bowstring release device with the safety mechanism of the present invention in non-engaged position in sectional view. The head 34*a* of pin 34 is shown recessed in concavity 38, so that shank 34*b* is not blocking the travel of trigger 24. Jaws 22 are held in support means 20 and are opened and closed by means of trigger 24. Slide cam 30 is assembled to the upper surface of support means 20 with guide block 32 slidably assembled into guide track 26 and being prevented from removal therefrom by fastener 27. Fastener 27 is preferably a screw, although a press-fit pin would perform the required holding function.

Figure 4:
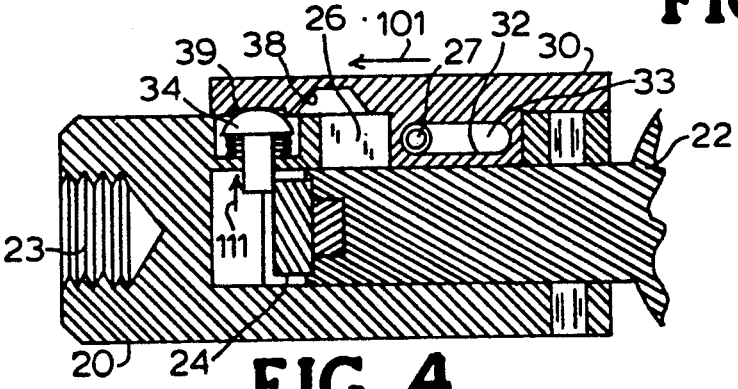
FIG. 4 is an elevation sectional view similar to FIG. 3, but showing the safety mechanism in position to block trigger movement so that the bowstring release device will not operate.

A comparison of FIG. 3 with FIG. 4 shows the non-engaged and engaged positions, respectively, of the safety mechanism of the invention. From the position shown in FIG. 3, movement of sliding cam 30 to the right as indicated by arrow 100 will cause lock pin 34 to move downward in the direction indicated by arrow 110, generally perpendicularly to the direction of movement of slide came 30. This downward movement of pin 34 compresses spring 36. When pin 34 moves down, shank 34*b* passes out through hole 28*b* and into recess 21 of support means 20 into a position immediately adjacent to and interfering with the movement of trigger 24. With pin 34 down and shank 34*b* blocking trigger 24 so it is unable to move, jaws 22 cannot open. With trigger 24 thus blocked and jaws 22 unable to open, the archery arrow cannot be discharged. Juxtaposed to the position of jaws 22 in FIGS. 3, 4 is threaded hole 23 which functions to anchor the bowstring release device to apparatus adapted to secure it to the wrist of the archer, i.e. a wrist strap.

From the position shown in FIG. 4, movement of sliding cam 30 to the left as indicated by arrow 101 will allow lock pin 34 to move upward in response to upward pressure of spring 36, as indicated by arrow 111. This upward movement of pin 34 removes shank 34*b* from the path of trigger 24, allowing the trigger 24 to move under pressure of the finger of the archer. With slide cam 30 in non-engaged position and lock pin 34 up, it is possible to open jaws 22 and release the arrow by pulling trigger 24.

Figure 5:
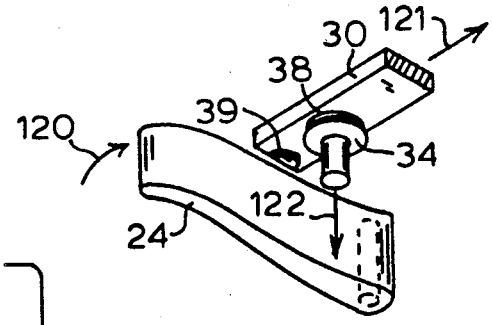
FIG. 5 is a perspective view oriented 90° with respect to FIG. 1 for purposes of illustration and showing the components comprising the safety mechanism in operating relationship but without the support means of the bowstring release device.

The action of the safety mechanism of the invention relative to trigger 34 may best be visualized from the perspective view of the operative components shown in FIG. 5. With the components in the positions illustrated, trigger 24 is free to be moved according to arcuate arrow 120, which movement will open the jaws (not shown in this figure) holding the string and archery arrow. When sliding cam 30 is moved in the direction indicated by arrow 121, it also forces the head of locking pin 34 out of conical concavity 38 and downwardly as shown by arrow 122, which places the shank of pin 34 in a position to block movement of trigger 24. With slide cam 30 moved fully in the direction of arrow 121, the head of pin 34 will rest in recess 39 so as to resist accidental movement of cam 30. When trigger 24 is in the discharged position and the jaws are open, trigger 24 will not allow pin 34 to move downwardly, thus assuring that the safety mechanism will be operative only when the jaws are closed.

Therefore, it is seen that the objectives of the present invention are realized by the safety mechanism disclosed. The mechanism in the preferred embodiment is simple and operates in a logical, understandable manner for the user. Since the bowstring release device is intended for use with either a right or a left hand, the safety will, likewise be useable in either the position as illustrated or in a position such that sliding cam 30 is on the bottom of support means 20 so descriptions using upwardly or downwardly relate to the positions as illustrated.

The description and operation according to the preferred embodiment are used as examples and not to be construed as limitations of the scope and principles of the invention. Various other configurations as will be obvious to those skilled in the art are similarly within the scope and spirit of the invention, including adaptations of the principles of the invention to bowstring release devices other than that referenced here.

What is claimed is:

1. A safety mechanism to prevent the accidental discharge of a bowstring release device having a movable trigger, said safety mechanism comprising:

(a) trigger motion blocking means assembled to said bowstring release device and being linearly moveable between a position of interference with the movement of said trigger and a position out of such interference and being biased out of said interference position; and (b) a blocking means cam mounted on said bowstring release device being movable in a plane substantially perpendicular to the direction of linear motion of said trigger motion blocking means and operable to place said trigger motion blocking means in position to interfere with the movement of said trigger.

2. A safety mechanism to prevent the accidential discharge of a bowstring release device having a movable trigger, said safety mechanism comprising:

(a) a lock pin mounted on said bowstring release and adapted to move between a first and a second pin position, said first pin position being out of interference with said trigger and said second pin position being in interference with said trigger;

(b) a spring assembled to said bowstring release and adapted to bias said lock pin toward said first pin position;

(c) a slide cam mounted slidably on said bowstring release device in contacting relationship with said lock pin and movable between a first and a second cam position, said first cam position being such that said lock pin is retained in said first pin position and said second cam position such that said lock pin is in said second pin position; and (d) a retaining fastener adapted and assembled to said bowstring release device to keep said slide cam in sliding relation on said bowstring release device.

3. The safety mechanism as claimed in claim 2 in which said slide cam is movable linearly with respect to said bowstring release device.

4. The safety mechanism as claimed in claim 2 in which said lock pin is movable in a direction generally perpendicular to the direction of movement of said slide cam.

5. The safety mechanism as claimed in claim 2 in which said slide cam comprises two recesses, one corresponding to the first cam position and the other corresponding to the second cam position relative to said lock pin.

6. A safety mechanism to prevent the accidental discharge of a bowstring release device having a moveable trigger, said safety mechanism comprising:

(a) trigger motion blocking means assembled to said bowstring release device and guided for linear movement between a first position in which said blocking means does not interfere and a second position in which said blocking means does interfere with the motion of said trigger and including means for biasing said blocking means toward said first position; and (b) a blocking means cam mounted on said bowstring release device in contacting relation with said trigger motion blocking means and moveable linearly in a plane substantially perpendicular to the line of movement of said trigger motion blocking means and operable when moved in a selected direction to place said trigger motion blocking means in said second position.

* * * * *

UNITED STATES PATENT AND TRADEMARK OFFICE

CERTIFICATE OF CORRECTION

PATENT NO. : 5,184,596

DATED : February 9, 1993

INVENTOR(S) : James H. Greene, John F. Greene, Jr.

It is certified that error appears in the above-identified patent and that said Letters Patent is hereby corrected as shown below:

On the title page, Item [76]:
Inventors should be corrected to read --James H. Greene-- and --John F. Greene, Jr.--

Column 3, line 13, after "cam" add --30--.

Signed and Sealed this

Fourteenth Day of December, 1993

Bruce Lehman

*Attest:*

BRUCE LEHMAN

*Attesting Officer*

*Commissioner of Patents and Trademarks*